US007976309B1

(12) United States Patent
Jones et al.

(10) Patent No.: US 7,976,309 B1
(45) Date of Patent: Jul. 12, 2011

(54) METHOD AND APPARATUS FOR SIMULATING WEAPON EXPLOSIONS INSIDE A CHAMBER

(75) Inventors: Giles D. Jones, Chino Hills, CA (US); Qingce Bian, Corona, CA (US); Christopher A. Tomlinson, Vail, AZ (US); Jeffrey E Decker, Moreno Valley, CA (US); William W. Price, Upland, CA (US); Bradley C Huang, Chino Hills, CA (US); Peter M. Wallrich, Upland, CA (US)

(73) Assignee: Raytheon Company, Waltham, MA (US)

( * ) Notice: Subject to any disclaimer, the term of this patent is extended or adjusted under 35 U.S.C. 154(b) by 1075 days.

(21) Appl. No.: 11/553,697

(22) Filed: Oct. 27, 2006

(51) Int. Cl.
*F41G 3/26* (2006.01)

(52) U.S. Cl. ..... 434/21; 434/11

(58) Field of Classification Search ..... 434/11, 434/16, 19–23; 365/19–27; 463/5, 12, 35; 102/355, 427; 342/457; 250/208.1; 703/6, 703/12

See application file for complete search history.

(56) References Cited

U.S. PATENT DOCUMENTS

| | | | | |
|---|---|---|---|---|
| 3,596,078 | A | 7/1971 | Owens | |
| 4,014,262 | A | 3/1977 | Betts | |
| 4,823,401 | A | 4/1989 | Gammarino et al. | |
| 5,199,874 | A | 4/1993 | Campagnuolo et al. | |
| 5,246,372 | A | 9/1993 | Campagnuolo et al. | |
| 5,351,623 | A | 10/1994 | Kissel et al. | |
| 5,474,452 | A | 12/1995 | Campagnuolo | |
| 5,481,979 | A | 1/1996 | Walder | |
| 6,065,404 | A | 5/2000 | Ripingill et al. | |
| 6,411,424 | B1 | 6/2002 | Raj | |
| 6,579,097 | B1 * | 6/2003 | Sampson et al. | 434/21 |
| 6,965,542 | B1 | 11/2005 | Harrington et al. | |
| 7,191,708 | B2 | 3/2007 | Ouliarin | |
| 2007/0264616 | A1 | 11/2007 | Namgung | |
| 2008/0187888 | A1 | 8/2008 | Jones et al. | |
| 2009/0035730 | A1 * | 2/2009 | Lindero | 434/22 |
| 2009/0165664 | A1 | 7/2009 | Jones | |
| 2010/0003643 | A1 | 1/2010 | Seo | |
| 2010/0058947 | A1 | 3/2010 | Davis | |
| 2010/0099059 | A1 | 4/2010 | Burford | |

OTHER PUBLICATIONS

Jones et al., "Simulated Mine," U.S. Appl. No. 12/266,175, 24 pages, filed Nov. 6, 2008.

Davis et al., "Simulated Hand Grenade Having a Multiple Integrated Laser Engagement System," U.S. Appl. No. 12/206,339, 27 pages, filed Sep. 8, 2008.

Davis et al. USPTO, "Office Action Summary," U.S. Appl. No. 12/206,339, Sent Apr. 29, 2010, 5 pages.

Davis et al., "Response Pursuant to 37 C.F.R. 1.111," U.S. Appl. No. 12/206,339, filed Jul. 28, 2010, 12 pages.

* cited by examiner

*Primary Examiner* — Xuan M Thai
*Assistant Examiner* — Timothy Musselman
(74) *Attorney, Agent, or Firm* — Baker Botts L.L.P.

(57) ABSTRACT

According to one embodiment of the invention, there is provided a method for simulating damage inside a chamber in response to receiving a detection signal from one or more sensors outside the chamber. The method includes receiving the detection signal from the one or more sensors located outside the chamber in response to the one or more sensors detecting a simulated hit to outside the chamber. In response, emitting light from one or more light sources to simulate damage inside the chamber.

25 Claims, 6 Drawing Sheets

METHOD AND APPARATUS FOR SIMULATING WEAPON EXPLOSIONS INSIDE A CHAMBER

GOVERNMENT RIGHTS

This invention was made with Government support under N61339-00-D-0001 awarded by the Naval Air Warfare Center, Training Systems Division for the Program Executive Office for Simulation, Training, and Instrumentation (PEO STRI). The Government has certain rights in this invention.

TECHNICAL FIELD

This invention relates generally to the field of tactical and combat training and more specifically to a method and apparatus for simulating weapon explosions inside a chamber.

BACKGROUND

Simulated weaponry is used to train personnel in a realistic, but safe environment. In some cases, simulated weapons may be used to simulate damage to the outside of a building. Simulated weapons outside a building do not necessarily have a line of sight to personnel within the building. For this reason, when a building incurs simulated damage from a simulated weapon, an umpire must manually designate human causalities inside the building.

SUMMARY OF THE DISCLOSURE

According to one embodiment of the invention, a method is provided for simulating damage inside a chamber in response to receiving a detection signal from one or more sensors outside the chamber. The method includes receiving the detection signal from the one or more sensors located outside the chamber in response to the one or more sensors detecting a simulated hit to outside the chamber. In response to receiving the detection signal, emitting light from one or more light sources to simulate damage inside the chamber.

According to another embodiment of the invention, a method is provided for simulating weapon damage inside an enclosure in response to detecting a simulated weapon hit to the outside of the enclosure. The method includes receiving a detection signal from a sensor located on the outside of the enclosure. The detection signal is sent from the sensor in response to detecting a simulated weapon hit to the outside of the enclosure. In response to receiving the detection signal, emitting light from an array of unfocused laser diodes to simulate weapon damage inside the enclosure. Simulated weapon damage is associated with the simulated weapon hit to the outside of the enclosure.

Certain embodiments of the invention may provide one or more technical advantages. A technical advantage of one embodiment may be that simulating explosions inside a chamber and associated damage due to simulated weapons hitting outside the chamber is automated. This automatic simulation eliminates the need for personnel to enter the chamber to designate causalities and other destruction inside the chamber. Another technical advantage of one embodiment may be improved realism of the simulated explosion.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 5 of the drawings, like numerals being used for like and corresponding parts of the various drawings.

Figure 1A:
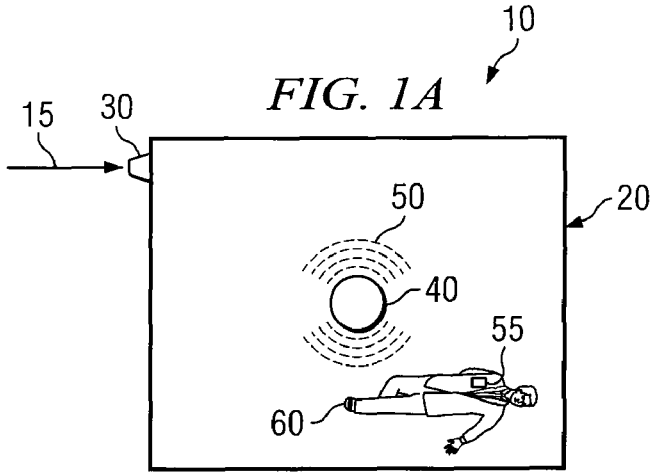
FIG. 1A is a schematic diagram illustrating a system for simulating a weapon explosion inside a chamber in accordance with certain embodiments of the present invention.

FIG. 1A is a schematic diagram illustrating certain embodiments of a system 10 for simulating a weapon explosion inside a chamber 20. System 10 may include a sensor 30 and a light source 40. Sensor 30 may detect a simulated weapon hit 15 outside chamber 20 and may send a detection signal to light source 40. In response, light source 40 may trigger laser diodes, or other suitable devices, to spray light 50 within chamber 20 to simulate a weapon explosion. In some embodiments, laser diodes 200 may be unfocused in order to spray light to a wider array of area inside of chamber 20 than with a focused light beam in order to more accurately simulate explosions inside chamber 20. Focused lasers have been previously used to simulate small arms weapons to trigger a receiver on target 60 such as in laser tag. Using unfocused lasers may improve the scope of the simulated weapon damage inside chamber 20 and the realism of a training session.

Receiver 55 inside chamber 20 may receive light 50 and determine whether target 60 inside chamber 20 received simulated damage from the simulated weapon explosion. Once receiver 55 detects light 50, target 60 may be notified that target 60 is damaged and/or can no longer participate in the training session. Accordingly, system 10 may simulate a weapon explosion and an associated damage inside chamber 20 due to simulated weapon hit 15 outside chamber 20 without a line of sight to target 60. This simulated weapon explosion may eliminate or reduce the need for umpires entering chamber 20 to designate human casualties and other damage.

Such automation may improve the realism of the training session and reduce the cost of the simulation by eliminating the need for extra personnel.

Chamber 20 may refer to a space that is at least partially enclosed. Some examples of chambers 20 may include a room, a stairwell, a hallway, or a vehicle compartment. Simulated weapon hit 15 may refer to a strike from a simulated weapon. Simulated weapons may include small or heavy arms weapons such as a simulated tank, or other simulated weapons.

Sensor 30 may refer to any combination of software and/or hardware that detects simulated weapon hit 15. Sensor 30 may detect simulated weapon hit 15 by any suitable method. For example, sensor 30 may detect simulated weapon hit 15 as a laser emission, electrical signal, heat emission, vibration, or other stimulus. Examples of sensors 30 may include photoswitches or photosensors such as chemical detectors, photoresistors, photovoltaic cells, photodiodes, photomultiplier tubes, phototubes, phototransistors, optical detectors, cryogenic detectors, which detect a laser light beam or other sources of light. Sensors 30 may be located on any surface, in a structure, or any other suitable place for detecting simulated weapon hit 15. In some embodiments, one or more sensors 30 may be used to detect simulated weapon hit 15 by being placed on the outside wall of a building.

Light source 40 may refer to any source of light suitable for simulating an explosion within chamber 20 in response to a detection signal from sensor 30. One example light source 40 is described in greater detail below in conjunction with FIG. 2A.

Receiver 55 may refer to any device for detecting light 50 from light source 40 and for indicating simulated damage. Receiver 55 may be located on target 60. In one embodiment, receiver 55 may be located on a Multiple Integrated Laser Engagement System (MILES) vest. Typically, a MILES vest has several small laser receivers to detect when a soldier has been shined by a laser from a simulated small firearm.

When the MILES system registers a hit, the MILES system will look in a table to determine whether the simulated weapon is capable of damaging the target and will notify the target if damage was done.

Target 60 may refer to any combination of structures, moving vehicles, weapons, personnel, or other suitable objects subject to simulated damage by simulated weapons. In the illustrated examples, targets 60 are people. In another example, target 60 may be a weapon. In yet another example, target 60 may be a command post inside a building. In this example, one receiver 55 may be placed in the center of the command post to receive light 50 to determine destruction of the command post. In yet another example, target 60 may be the occupants of a moving vehicle. In this example, sensor 30 on the vehicle may detect the simulated hit and trigger a light source 40 inside the vehicle to simulate damage to the occupants.

Figure 1B:
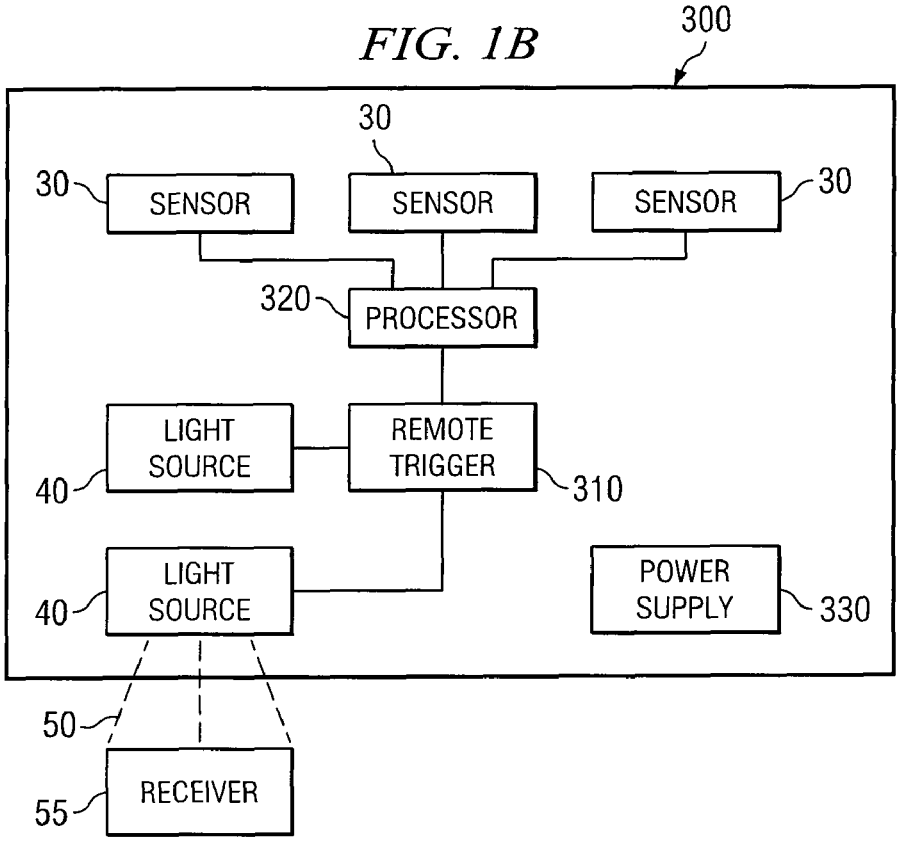
FIG. 1B is a block diagram of the system for simulating an explosion inside a chamber in accordance with certain embodiments of the present invention.

FIG. 1B is a block diagram of system 10 for simulating a weapon explosion inside a chamber in accordance with certain embodiments of the present invention. According to this embodiment, system 10 includes light sources 40, sensors 30, a remote trigger 310, a processor 320, a power supply 330, and a receiver 55. Sensors 30 are communicatively coupled to processor 320. Processor 320 is coupled to remote trigger 310. Remote trigger 310 is coupled to each light source 40. Each light source 40 communicates with at least one receiver 55. Power supply 330 is coupled to light sources 40, processor 320, and remote trigger 310.

In the illustrated embodiment, sensors 30 may detect simulated hit 15 from a simulated weapon. Sensors 30 may communicate detection signals to processor 320. In one case, detection signals may be communicated through a wire to processor 320. In other cases, detection signals may be communicated to processor 320 wirelessly.

Processor 320 may refer to a computing device or other processor, and/or software for accessing, retrieving, and processing a detection signal and triggering remote trigger 310 to activate light sources 40. In one embodiment, processor 320 may trigger remote trigger 310 to activate certain laser diodes within certain light sources 40. In another embodiment, processor 320 may trigger light sources 40 to activate laser diodes to emit a select amount of light energy to represent the effective range of the simulated weapon. In response to triggering, light sources 40 emit light 50 in the illustrated embodiment. Receiver 55 receives emitted light 50.

Modifications, additions, or omissions may be made to system 10 without departing from the scope of the invention. The components of system 10 may be integrated or separated according to particular needs. Moreover, the operations of system 10 may be performed by more, fewer, or other modules. For example, the operations of remote trigger 310 and processor 320 may be performed by light source 40, or the operations of processor 320 may be performed by more than one module. Additionally, operations of system 10 may be performed using any suitable logic comprising software, hardware, other logic, or any suitable combination of the preceding.

Figure 2B:
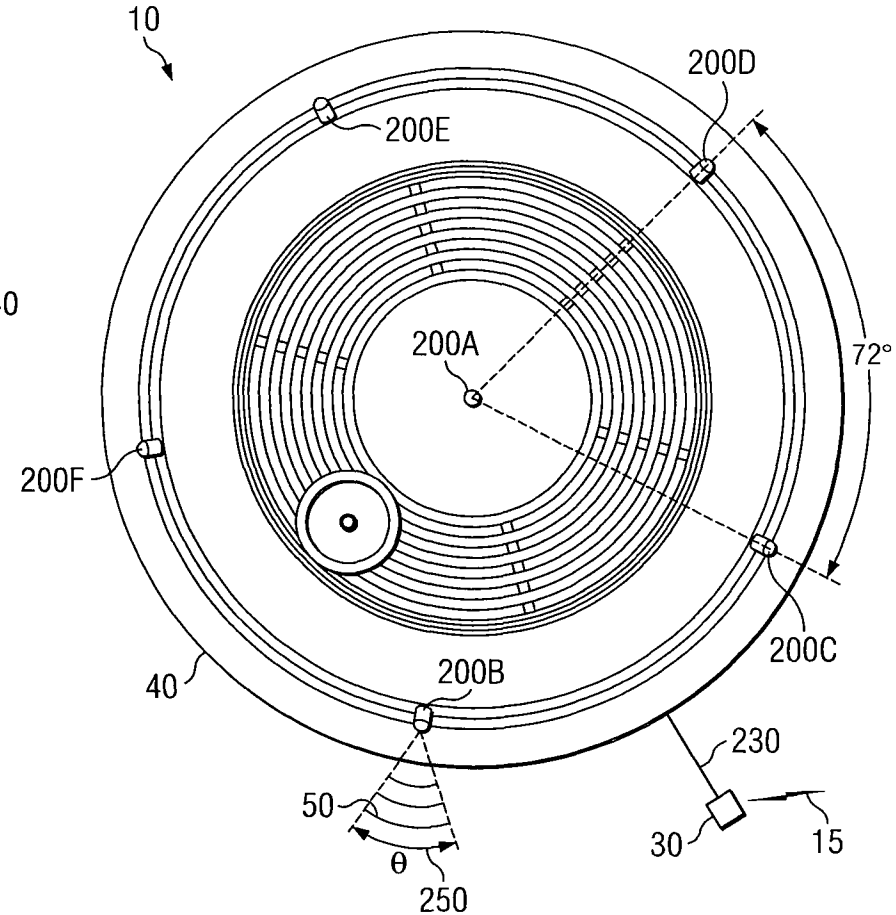
FIG. 2B is a plan view showing additional detail of the system in accordance with one embodiment of the present invention.
Figure 2A:
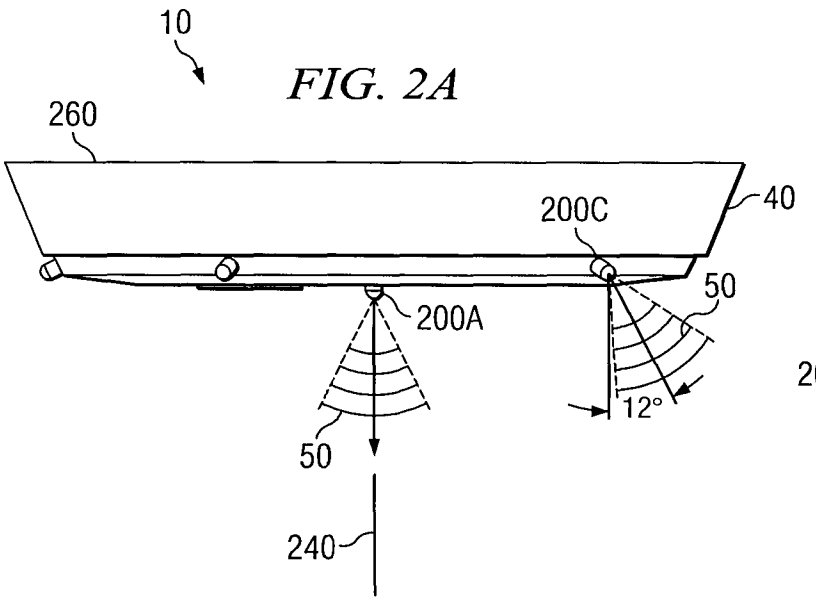
FIG. 2A is a side view showing additional detail of the system in accordance with one embodiment of the present invention.

FIGS. 2A and 2B are a plan view and a side view showing additional detail of system 10 in accordance with one embodiment of the present invention. FIG. 2B illustrates sensor 30, a wire 230, and light source 40. In this embodiment, sensor 30 is communicatively coupled to light source 40 through wire 230. In other embodiments, sensor 30 may communicate wirelessly with light source 40.

In some embodiments, light source 40 may include a plurality of unfocused laser diodes 200, other light emitters, or any other suitable sources of light. Unfocused laser diodes 200 may in some embodiments, emit light 50 in an angular distribution within a plane or alternatively, in a cone or other configuration. In some cases, unfocused laser diodes 200 may be positioned at a plurality of angles to emit light in multiple directions into chamber 20. Some embodiments of light source 40 may include modules to receive the detection signal from sensors 30 and to trigger a plurality of laser diodes 200 to emit light 50. These modules are described in greater detail below in conjunction with FIG. 5A and 5B.

In some embodiments, laser diodes 200 may be arranged within light source 40 to direct a divergence of light energy from laser diodes 200 to simulate an explosion within chamber 20. In the illustrated embodiment, five laser diodes 200*b-f* are arranged at seventy-two degrees around an edge of housing 220 and a single laser diode 200*a* is located at the center of housing 220. In other embodiments, other suitable arrangements may be used. In the illustrated embodiment, the single laser diode 200*a* is aimed downward, parallel to a vertical axis 240. Laser diodes 200*b-f* distributed along the edge of housing 220 are aimed at an angle of twelve degrees from vertical axis 240. In the illustrated example, laser diodes 200*a-f* are arranged within housing 220 to spray light energy in diverging directions throughout chamber 20. Other suitable arrangements may also be used to direct light 50 in other directions, including arranging each laser diode (or other source of light) directing a cone of light rather than light in a single plane.

Light source 40 may include a housing 220 in some embodiments. Housing 220 may be any suitable container for sources of light within chamber 20. In some cases, housing 220 may be camouflaged so personnel are unaware of the location of the sources of light. In the illustrated example, housing 220 is camouflaged as a smoke detector. Housing 220 may include openings for light 50 from laser diodes 200 or other light emitters. Housing 220 may have one or more faces in some embodiments. In one example, housing 220 may have a face for mounting sources of light to a surface of chamber 20. In the illustrated embodiment, housing 220 has a horizontal face 260 for mounting light source 40 on the ceiling of chamber 20. In other embodiments, housing 220 may be adapted to locate light source 40 in any portion of chamber 20 and to send light 50 to certain areas within chamber 20. In one example, housing 220 may be of a spherical shape. In some cases, housing 220 may be suspended in the center of a room so that light 50 can be emitted in different directions from housing 200. In one case, laser diodes 200 may be aimed in outward directions in a spherical-shaped housing 220 suspended in the center of the room to emit light 50 in all directions.

Figure 2C:
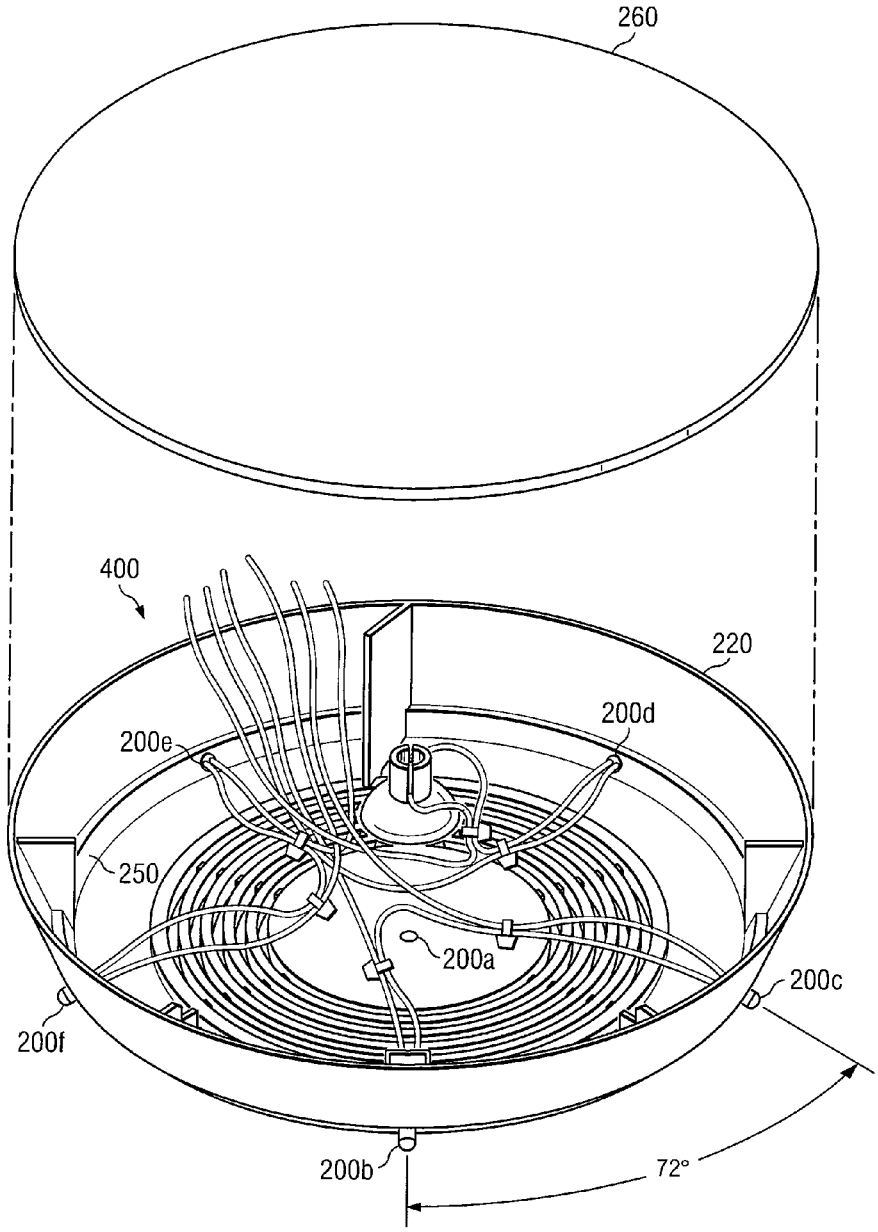
FIG. 2C is a laser diode arrangement within a housing in accordance with one embodiment of the invention.

FIG. 2C is a laser diode 200 arrangement within housing 220 in accordance with one embodiment of the invention. According to the illustrated embodiment, laser diodes 200 include five laser diodes 200*b-f* arranged around the edge of housing 220 and one laser diode 200*a* located near the center of housing 220.

In some embodiments, laser diodes 200 may be arranged to emit a divergence of light throughout chamber 20. In the illustrated embodiment, laser diodes 200*b-f* are arranged around the edge of housing 220 at a seventy two degree spacing. Laser diodes 200*b-f* are aimed at an angle of twelve degrees from an axis 240 perpendicular to a face 260 in housing 220. Laser diode 200*a* is located near the center of housing 220 and is aimed perpendicular to face 260 of housing 220. Laser diodes 200 in the illustrated embodiment are arranged to emit light substantially throughout chamber 20 when housing 220 is mounted to the ceiling of chamber 20. More specifically, this arrangement allows laser diodes 220 to emit light downward and outward from housing 220. In some cases, housing 220 includes openings to permit light 50 to travel through. In another embodiment, the same laser diode arrangement used in the illustrated embodiment may be used to emit light 50 down a stairwell by mounting housing 220 vertically. In other embodiments, laser diodes 200 may be aimed in radial directions in a housing 220 suspended in the center of chamber 20. In this embodiment, laser diodes 200 may emit light in all directions surrounding housing 220.

Figure 3:
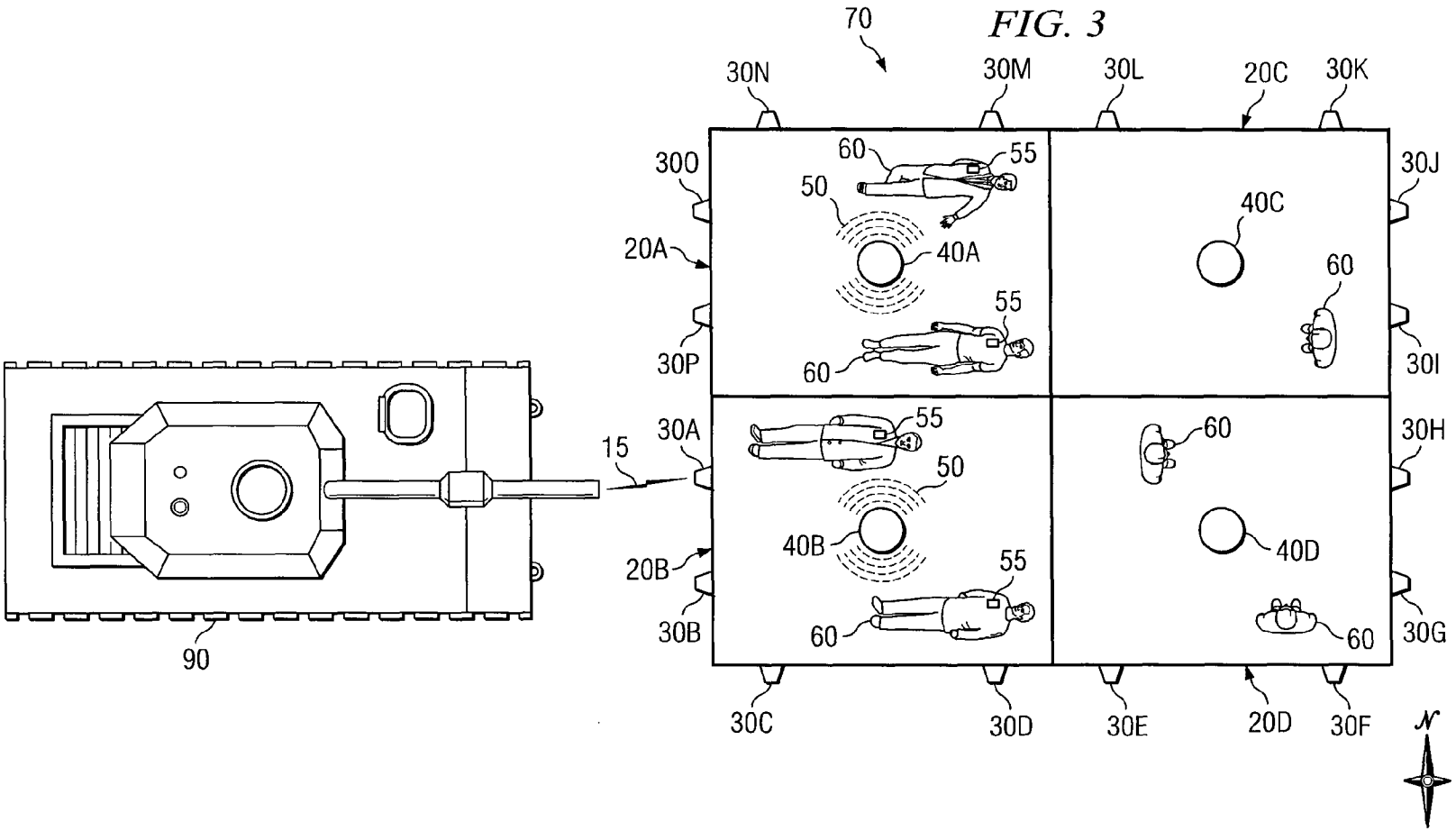
FIG. 3 is a schematic diagram illustrating a training scenario where embodiments of apparatus may be used in a multi-chambered enclosure.

FIG. 3 is a schematic diagram illustrating a training scenario where embodiments of apparatus may be used in a multi-chambered enclosure. An enclosure 70 may refer to a group of one or more chambers 20. Enclosure 70 may be a building with several rooms. Enclosure 70 may have an open portion, and thus not be completely enclosed. For example, a building may have an open doorway or window. FIG. 3 illustrates an enclosure 70 having chambers 20, a plurality of sensors 30 located on an outside wall of enclosure 70, a plurality of light sources 40 mounted in chambers 20, a plurality of targets 60 located inside chambers 20, and a simulated tank 90.

In the illustrated embodiment, simulated tank 90 fires at enclosure 70 causing simulated weapons hit 10 on, for example, the southwest portion of enclosure 70. In this embodiment, simulated hit 15 activates sensor 30*a* on the outside of chamber 20*b* to indicate that the southwest portion of enclosure 70 has been hit. In the illustrated embodiment, sensor 30*a* triggers light sources 40*a* and 40*b* in chambers 20*a* and 20*b* which are closest to the impact site of simulated hit 15. Light sources 40*a* and 40*b* simulate explosions by emitting light 50 into chambers 20*a* and 20*b*. In this embodiment, light sources 40*a* and 40*b* may be selectively triggered by simulated hit 15 to sensor 30*a*; however, in other embodiments, sensor 30*a* may trigger light sources 40 to simulate explosions throughout enclosure 70 to simulate destruction of the entire enclosure 70. This selective damage may depend on a simulated strength of simulated hit 15 detected by sensor 30*a*.

Figure 4:
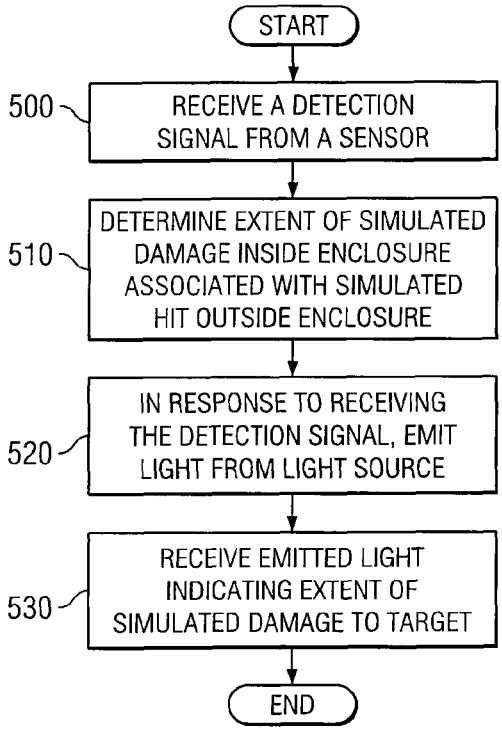
FIG. 4 is a flowchart of a method for simulating an explosion inside a chamber in response to receiving a detection signal from one or more sensors outside the chamber, in accordance with one embodiment of the invention.

FIG. 4 is a flowchart of a method for simulating an explosion inside chamber 20 in response to receiving a detection signal from one or more sensors 30 outside chamber 20, in accordance with one embodiment of the invention.

At step 500, a detection signal is received from one or more sensors 30. Sensors 30 may send the detection signal in response to receiving simulated weapons hit 10 in some embodiments. In other embodiments, another suitable source may send the detection signal. For example, a software program that simulates weapon impacts may trigger sensors 30 to send the detection signal.

Simulated weapons hit 10 may trigger sensors 30 by any suitable method. In one embodiment, a laser may fire a light beam at chamber 20 triggering sensors 30. For example, a simulated small weapon may include a laser for firing at targets 60 with receivers 55 such as in laser tag. In one case, targets 60 may wear MILES vests. In another embodiment, sensors 30 may be triggered by pressure. Once triggered, sensors 30 may send a detection signal to light sources 40 within enclosure 70 in some embodiments At step 510, the extent of simulated damage to targets 60 inside enclosure 70 associated with simulated hit 15 to the outside of enclosure 70 is determined. In some embodiments, the extent of simulated damage may refer to the type and amount of simulated damage to targets 60 inside enclosure 70. In some embodiments, the extent of simulated damage may be determined using the detection signal from sensors 30. In one embodiment, processor 320 or other system module may determine the extent of simulated damage.

The determined extent of simulated damage may be used to selectively activate light sources 40. In some cases, the determined extent of simulated damage may be used to selectively activate laser diodes 200 to emit light 50 in select directions within each chamber 20.

In one embodiment, this method may determine that the extent of simulated damage is total destruction of enclosure 70. In these embodiments, all light sources 40 in all chambers 20 of enclosure 70 are activated.

In another embodiment, this method may determine that certain chambers 20 within enclosure 70 are destroyed. In some cases, the detection signal may be used to determine which chambers 20 were destroyed. For example, the left side of a building may receive simulated hit 15. In this example, only sensors 30 on the left side of the building may have been triggered. In one embodiment of this method, the detection signal from sensors 30 triggered on the left side of the building may be analyzed to determine that the simulated damage is localized to the left side of the building. In response, only laser diodes 200 in light sources 40 located in chamber 20 on the left side of the building may be activated.

In yet another embodiment, this method may determine a destruction zone within chamber 20. A destruction zone may refer to a portion of chamber 20 incurring damage or the extent of damage to a particular target 60 in some embodiments. The detection signal may be analyzed to determine the destruction zone due to simulated hit 15. For example, a simulated weapon may have impacted an area near a building or grazed the building. In this example, a single sensor 30 closest to the impact zone may be triggered or a sensor may be triggered at an obtuse angle. The triggered sensor may send a detection signal indicating minimal damage to the corner of the room closest to the impact zone. In response, certain laser diodes 200 facing the damaged corner of the room may be triggered to send light to that corner. Any receivers 55 in that corner would receive light 50.

At step 520, light 50 is emitted in response to receiving a detection signal. In some embodiments, all laser diodes 200 within a light source 40 may be activated. In other embodiments, certain laser diodes 200 aimed at a determined destruction zone may be activated. In other embodiments, a certain amount of light 50 may be emitted in response to receiving a detection signal.

At step 530, emitted light 50 is received indicating the extent of simulated damage to target 60. In some embodiments, receiver 55 may receive emitted light from laser diodes 200 indicating simulated damage to target 60. In other embodiments, receiver 55 may receive other suitable stimulus indicating simulated damage. In some embodiments, target 60 may receive light or other stimulus from light sources 40 indicating stimulated damage. For example, target 60 may see light 50 emitted from laser diodes 200.

In some embodiments, receiver 55 may notify target 60 of the extent of damage to target 60. For example, receiver 55 may notify a target 60 that target 60 has been mortally wounded in the simulation. In this example, target 60 may be removed from the simulation exercise. In another example, receiver 55 may notify target 60 that target 60 has sustained simulated minor injuries. In this example, target 60 may choose to take measures to protect himself from further simulated damage. In another example, receiver 55 may notify a medic of the extent of damage to determine which first aid method to practice. In yet another example where target 60 is a command post, receiver 55 may notify the command post that it has been disabled and that a certain percentage of the personnel have incurred simulated damage.

In some embodiments, notification of simulated damage to target 60 is automatic. This automatic notification may eliminate or reduce the need for umpires entering chamber 20 to designate human casualties and other damage. Such automation may improve the realism of the training session and reduce the cost of the simulation by eliminating the need for extra personnel.

Receiver 55 may be suitably located in some embodiments to notify target 60 of the simulated damage. In one embodiment, receiver 55 may be attached to target 60 to receive emitted light 50 to indicate target 60 has been hit such as in laser tag. In other embodiments, receiver 55 may be mounted remotely. In some cases, receiver 55 may include an alarm to notify target 60 of simulated damage. In other cases, receiver 55 may include a light emitter to indicate simulate damage.

Modifications, additions, or omissions may be made to the method without departing from the scope of the invention. The method may include more, fewer, or other steps.. Additionally, steps may be performed in any suitable order without departing from the scope of the invention.

Figure 5B:
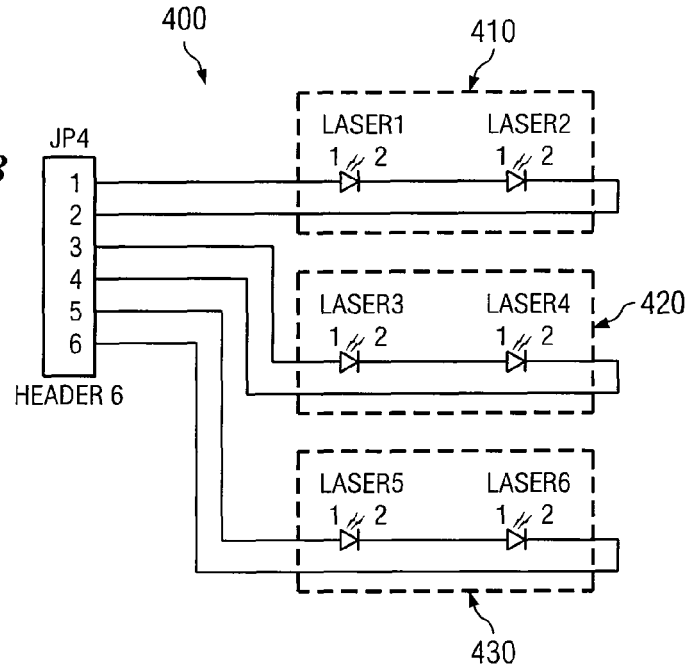
FIG. 5B is a laser diode wiring scheme in accordance with one embodiment of the invention.
Figure 5A:
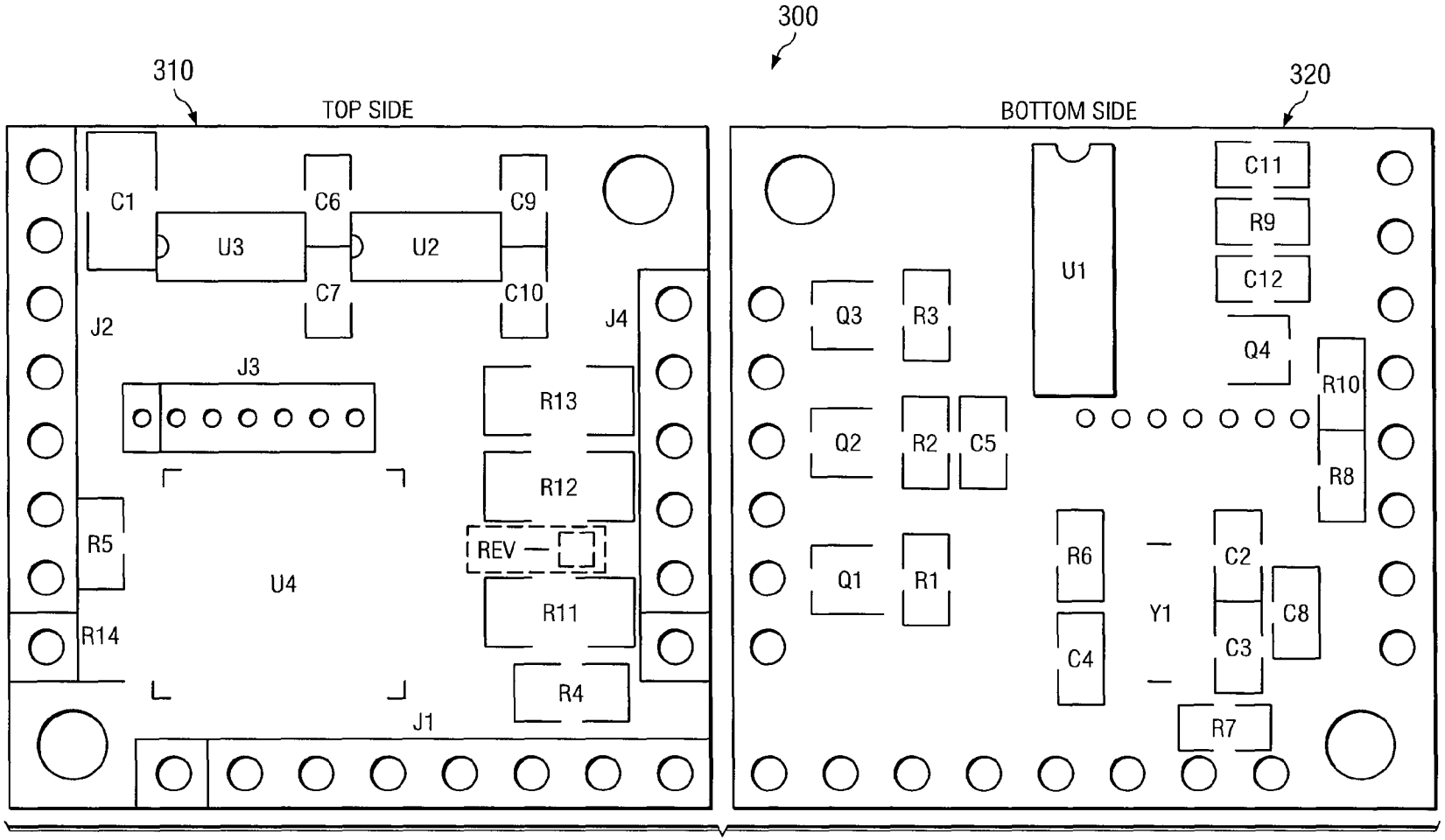
FIG. 5A is a controller board layout, in accordance with one embodiment of the invention.

FIG. 5A is a controller board layout 300, in accordance with one embodiment of the invention. In the illustrated embodiment, controller board layout 300 includes a top side 310 and a bottom side 320. Top side 310 includes a processor 320, a power supply, a laser power, a USB interface, a trigger interface, and other controller board modules. Bottom side 320 includes a system clock, a set of laser drivers, a utility device interface, and other controller board modules. The controller board 300 in the illustrated embodiment may be used to analyze the detection signal from sensors 30, select light sources 40, and trigger selected light sources 40. In one embodiment, controller board 300 may be used to determine the extent of damage. In another embodiment, controller board 300 may also be used to determine the amount of light energy to emit from laser diodes 200 in light source 40.

FIG. 5B is a laser diodes wiring scheme 400 in accordance with one embodiment of the invention. According to this embodiment, laser array wiring scheme 400 wires together six laser diodes labeled LASER 1-6. LASER 1 and LASER 2 are wired together in series forming a first parallel pair 410. LASER 3 and LASER 4 are wired together in series forming a second parallel pair 420. LASER 5 and LASER 6 are wired together in series forming a third pair 430. In this embodiment, the three parallel pairs 410, 420, 430 of two laser diodes are wired together in series to accommodate even power distribution to LASER 1-6.

Although this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A method for simulating weapon damage inside an enclosure in response to detecting a simulated weapon hit to the outside of the enclosure, comprising:

receiving a detection signal from a sensor located on the outside of the enclosure, the detection signal sent from the sensor in response to detecting a simulated weapon hit to the outside of the enclosure;

in response to receiving the detection signal, determining an impact angle of the simulated weapon hit to the outside of the enclosure;

determining a destruction zone within the enclosure based at least in part on the impact angle of the simulated weapon to the outside of the enclosure; and simulating weapon damage inside the enclosure by selectively emitting light in one or more directions within the enclosure based at least in part on the destruction zone.

2. The method of claim 1, wherein selectively emitting light further comprises selectively emitting light from one or more light sources of a housing that is camouflaged such that the housing resembles a ceiling-mounted apparatus that performs a function other than simulating weapon damage inside an enclosure.

3. The method of claim 1, further comprising:

in response to the detection signal, determining an extent of the simulated weapon damage inside the enclosure caused by the simulated weapon hit to the outside of the enclosure; and selecting one of a plurality of light energy levels for the selectively emitted light, the selection based at least in part on the extent of simulated weapon damage inside the enclosure.

4. The method of claim 1, wherein selectively emitting light in one or more directions within the enclosure further comprises selectively emitting light from an array of unfocused laser diodes that are positioned to distribute the emitted light throughout a portion of the enclosure.

5. The method of claim 1, wherein receiving the detection signal comprises wirelessly communicating the detection signal from the sensor.

6. The method of claim 1, wherein receiving the detection signal comprises communicating the detection signal with a wire from the sensor to inside the enclosure.

7. The method of claim 1, wherein the enclosure is a building.

8. The method of claim 1, wherein the enclosure is a building with at least one open wall.

9. A method for simulating damage inside an enclosure in response to receiving a detection signal from one or more sensors outside the enclosure, comprising:

receiving the detection signal from the one or more sensors located outside the enclosure in response to the one or more sensors detecting a simulated hit outside the enclosure;

in response to receiving the detection signal, determining an impact location of the simulated hit outside the enclosure;

selecting a subset of multiple light sources inside the enclosure based at least in part on the proximity of each one of the subset of multiple light sources to the impact location of the simulated hit outside the enclosure, the subset of multiple light sources excluding at least one of the multiple light sources;

simulating damage inside the enclosure by selectively emitting light from the subset of multiple light sources inside the enclosure.

10. The method of claim 9, further comprising:

in response to the detection signal, determining an extent of the simulated damage inside the enclosure caused by the simulated hit outside the enclosure; and selecting one of a plurality of light energy levels for the selectively emitted light, the selection based at least in part on the extent of simulated damage inside the enclosure.

11. The method of claim 9, wherein each light source of the subset of multiple light sources is housed in a respective housing that is camouflaged such that the housing resembles an apparatus that performs a function other than simulating weapon damage inside an enclosure.

12. The method of claim 9, wherein:

the enclosure is a building; and the sensor is located outside the building.

13. The method of claim 9, wherein the subset of multiple light sources comprises a first light source located in a first chamber of the enclosure and a second light source located in a second chamber of the enclosure, the first chamber separated from the second chamber by at least one wall of the enclosure.

14. The method of claim 9, wherein selectively emitting light in one or more directions within the enclosure further comprises selectively emitting light from one or more light sources each comprising an unfocused laser diode operable to emit light in an angular distribution substantially in a plane.

15. The method of claim 9, wherein selectively emitting light in one or more directions within the enclosure further comprises selectively emitting light from one or more light sources each comprising an array of unfocused laser diodes positioned at a plurality of angles for emitting light in multiple directions over a portion of the enclosure.

16. The method of claim 9, further comprising receiving emitted light by a receiver on a target inside the enclosure, the receipt of the emitted light for indicating damage to the target.

17. An apparatus for simulating damage inside a chamber in response to detecting a simulated hit outside the chamber, comprising:

a controller comprising a processor, the controller configured to:

receive a detection signal from a sensor located remote from the controller and outside of the chamber, the detection signal sent from the sensor in response to detecting a simulated hit outside the chamber;

determine an impact angle of the simulated hit outside the chamber;

determine a destruction zone within the chamber based at least in part on the impact angle; and selectively switch on one or more light sources located inside the chamber such that the one or more light sources emit light in the direction of the destruction zone to limit simulated damage inside the chamber to the destruction zone.

18. The apparatus of claim 17, wherein the one or more light sources are further operable to selectively emit light in a subset of the multiple directions in response to a determination of the destruction zone, the subset of the multiple directions excluding at least one of the multiple directions.

19. The apparatus of claim 17, wherein the one or more light sources are camouflaged in a housing that resembles an apparatus that performs a function other than simulating damage inside the chamber.

20. The apparatus of claim 17, wherein the one or more light sources comprises a plurality of unfocused laser diodes in a housing having a face, the plurality of laser diodes comprising:

a plurality of first diodes, each first diode located at a first angle from the face; and a second diode located perpendicular to the face.

21. The apparatus of claim 17, further comprising a device responsive to receiving light from the light sources to indicate damage to a target.

22. The apparatus of claim 17, wherein the light emitted from the one or more light sources is a function of the a extent of simulated damage.

23. The apparatus of claim 17, wherein the chamber is a building.

24. The apparatus of claim 17, wherein the controller is further operable to wirelessly communicate with the sensor.

25. A method for simulating weapon damage inside an enclosure in response to detecting a simulated weapon hit to the outside of the enclosure, comprising:

receiving a detection signal from a sensor located on the outside of the enclosure, the detection signal sent from the sensor in response to detecting a simulated weapon hit to the outside of the enclosure; and in response to receiving the detection signal, determining an impact location and an impact angle of the simulated weapon hit to the outside of the enclosure;

determining a destruction zone within the enclosure based at least in part on the impact location and impact angle of the simulated weapon to the outside of the enclosure; and simulating weapon damage inside the enclosure by selectively emitting light in one or more directions within the enclosure based at least in part on the destruction zone.

* * * * *